United States Patent [19]

Arnell et al.

[11] 4,284,007

[45] Aug. 18, 1981

[54] PROJECTILE WITH AT LEAST ONE EXPELLABLE SUBPROJECTILE

[75] Inventors: Claes G. Arnell, Torshälla; Erik G. Olsson, Eskilstuna, both of Sweden

[73] Assignee: Förenade Fabriksverken, Eskilstuna, Sweden

[21] Appl. No.: 17,074

[22] Filed: Mar. 2, 1979

[30] Foreign Application Priority Data

Jan. 23, 1979 [SE] Sweden ..... 7900596

[51] Int. Cl.[3] ..... F42B 13/50

[52] U.S. Cl. ..... 102/477; 102/491; 102/499

[58] Field of Search ..... 102/69, 231–234, 102/252, 253

[56] References Cited

U.S. PATENT DOCUMENTS

| | | | |
|---|---|---|---|
| 1,999,747 | 4/1935 | Aragone | 102/233 |
| 2,044,026 | 6/1936 | Zornig | 102/234 |
| 2,149,469 | 3/1939 | Schenk | 102/232 |
| 2,359,752 | 10/1944 | Del Prato | 102/234 |
| 2,446,745 | 10/1948 | Delay | 102/233 |
| 2,777,392 | 1/1957 | Laakso | 102/234 |
| 3,858,515 | 1/1975 | Rusbach | 102/253 X |
| 3,980,021 | 9/1976 | Strandli | 102/56 R X |
| 4,020,766 | 5/1977 | Moyse | 102/231 |
| 4,098,192 | 4/1978 | Breed | 102/232 |

FOREIGN PATENT DOCUMENTS

| | | |
|---|---|---|
| 140550 | of 1949 | Sweden . |
| 367869 | of 1974 | Sweden . |

*Primary Examiner*—Peter A. Nelson

*Attorney, Agent, or Firm*—Fleit & Jacobson

[57] ABSTRACT

Projectile with at least one expellable subprojectile. The projectile is provided with a nose element, which is arranged, in a predetermined position in the trajectory of the projectile, to be discarded, thereby causing a decelerating force on the projectile. The fore subprojectile is provided with a deceleration-sensing device, which is capable of initiating the expelling of the subprojectile as a consequence of sensing said deceleration force. The subprojectiles in behind are arranged to be expelled either as a consequence of sensing deceleration forces occurring on expelling of the subprojectile immediately in front of it, or alternatively to be expelled in a conventional way with a delay relative to one another achieved through pyrotechnic delay.

3 Claims, 3 Drawing Figures

PROJECTILE WITH AT LEAST ONE EXPELLABLE SUBPROJECTILE

FIELD OF THE INVENTION

The present invention relates to a projectile of the kind stated in claim 1 provided with at least one expellable subprojectile. The denomination projectile refers here not only to a projectile which is fired by means of a firing device but also to bombs and similar which e.g. are dropped from aircraft.

PRIOR ART

In such known projectiles, when containing several subprojectiles, these subprojectiles have most frequently been arranged either to be expelled at the same time or they have been arranged to be expelled at different times relative to one another through pyrotechnic delay or through timeset fuzes. The bursting charge of the subprojectile is connected through a pyrotechnic delay train to the expelling charge which expels the subprojectile from the projectile. Such arrangements have not always proved to be reliable, particularly when the projectile has been stored for a long time. The arrangement of pyrotechnic trains has-regardless whether the projectile contains one or several subprojectiles-also made loading and assembly of the projectile more difficult.

SUMMARY OF THE INVENTION

The object of the present invention therefore is to provide a projectile of the kind set forth in the preamble of claim 1, which makes it possible, completely or partially to dispense with pyrotechnic trains. This object is fulfilled by the fact that the projectile in accordance with the present invention has been given the characteristics set forth in claim 1.

BRIEF DESCRIPTION OF THE DRAWING

The invention will be described in more detail below with reference to the drawing, which shows a preferred embodiment of the invention.

DESCRIPTION OF THE PREFERRED EMBODIMENT

Figure 1:
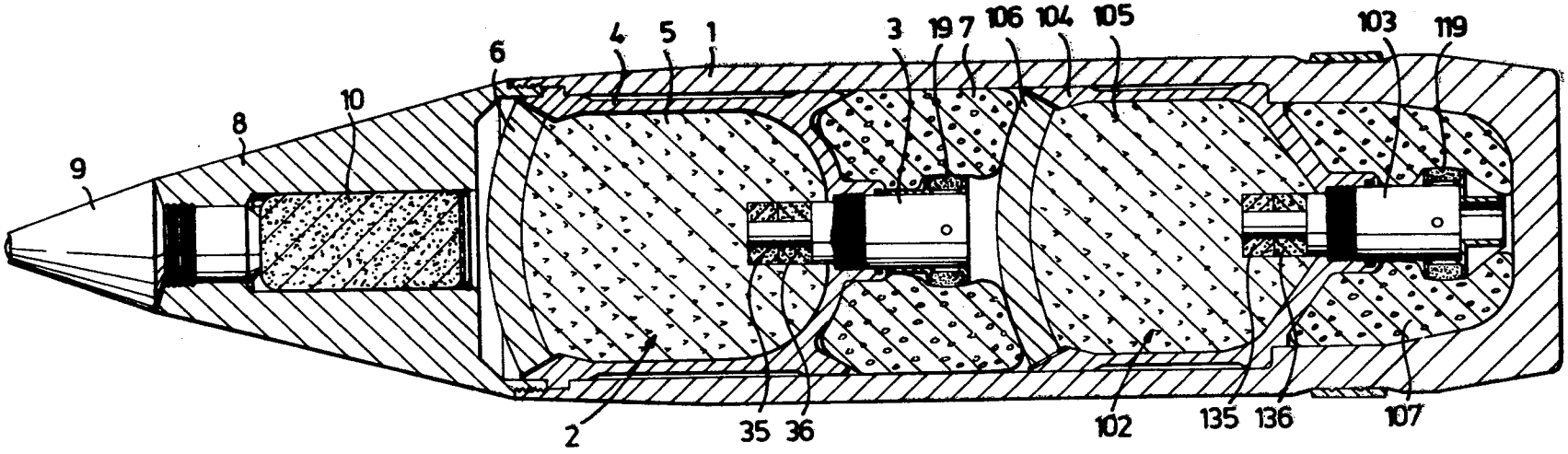
FIG. 1 shows an axial cross section of a projectile in accordance with the invention, containing two subprojectiles.

FIG. 1 shows an artillery shell 1 of rotating type. The invention is not, however, restricted to rotating projectiles. The shell 1 contains a fore subprojectile 2 and a rear subprojectile 102, each provided with a fuze 3 and 103 respectively. The difference between the subprojectiles 2 and 102 mainly concerns the fuzes. (The fuzes 3 and 103 are shown more closely in FIGS. 2 and 3 respectively.) Therefore only the design of one of the subprojectiles, 2, is described below. The designations 2, 3 etc. of the fore subprojectile 2 thereby correspond to the designations 102, 103 etc. of the rear subprojectile 102.

The subprojectile 2 consists of a cup-shaped metal element 4 containing a bursting charge 5 and in the front part a fragmentation plate 6, consisting of ball fragments or equal. Each subprojectile has its own expelling device, for example an expelling charge 7 and 107 respectively, which is arranged in a way stated below to be initiated by the fuze 3 and 103 respectively.

The front part of the shell 1 is provided with a nose element such as an adapter 8, the front part of which housing a conventional fuze (time or proximity fuze) 9. The adapter 8 contains an expelling device in the form of a propellant charge 10, which can be initiated by the fuze 9.

Figure 2:
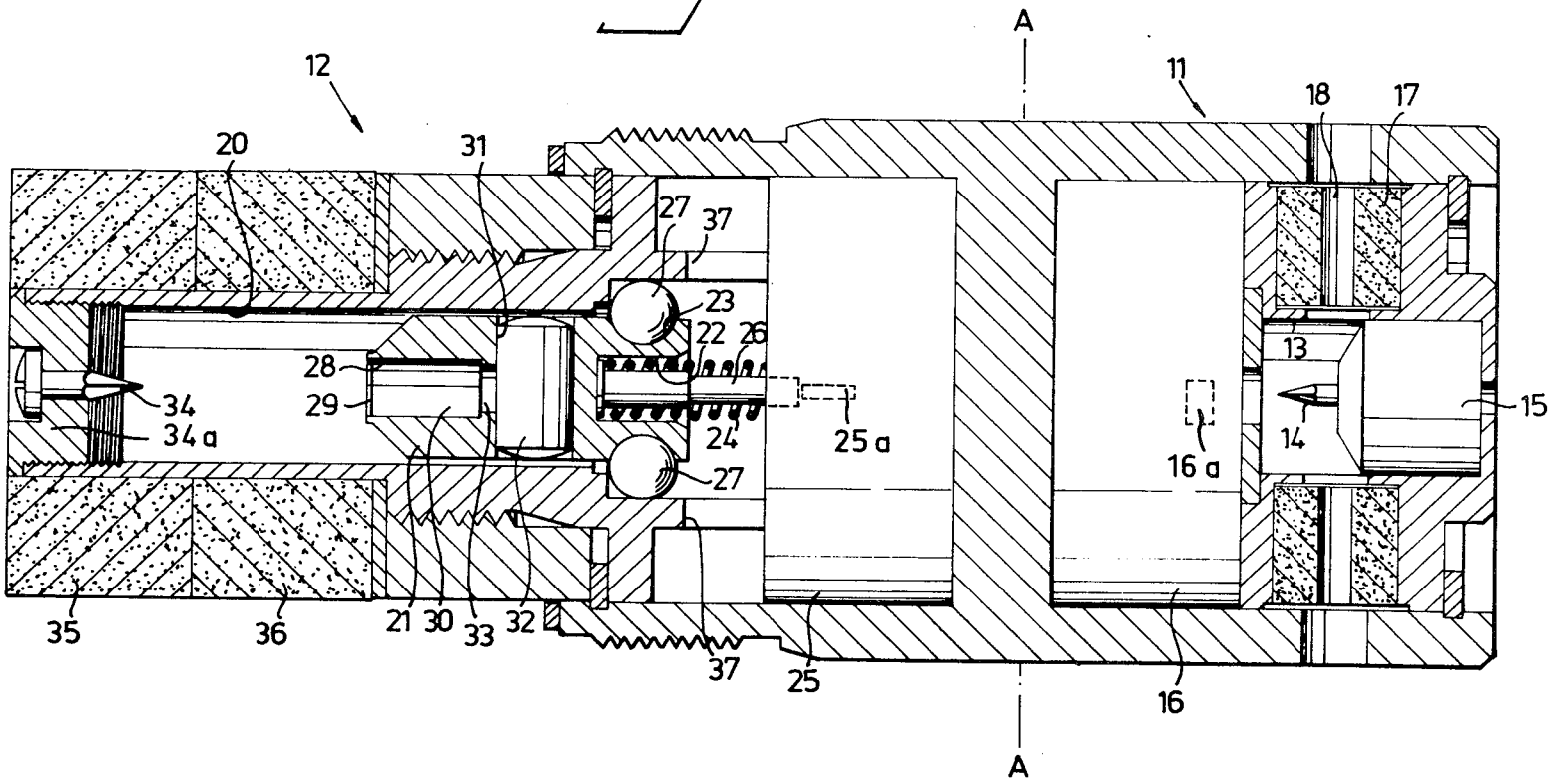
FIG. 2 shows an axial cross section of the fuze for the fore subprojectile shown in FIG. 1.

The fuze 3 is shown in detail in FIG. 2. The fuze 3 consists of a rear section 11, to the right of the dash line A—A, and a front section 12, to the left of the line A—A. The purpose of the section 11 is to initiate the expelling charge 7, while the purpose of the section 12 is to initiate the bursting charge 5.

The rear section 11 of the fuze 3 contains an axial groove 13, in which a deceleration-sensing device in the form of a magnet bolt 15 provided with a firing pin 14 is held at rest in the rear end of the groove 13 (to the right in FIG. 2) through magnetic locking. The magnetic locking is so strong that it is not cancelled by the normal deceleration forces which affect the projectile in its trajectory. Furthermore, the fuze 3 is provided with a conventional clockwork 16, which is arranged to, after a predetermined arming delay, which for instance can be made to depend on the rotation of the projectile, turn an initiation device, such as a schematically shown primer 16*a*, to an armed position in line with the firing pin 14. An annular charge 17 of pressed propellant with radial channels 18 surrounds concentrically the groove 13. The charge 17 is enclosed by a black-powder charge 19 in powder form (see FIG. 1). Expelling of the subprojectile 2 occurs in the following manner.

When the proximity and/or time fuze 9 (see FIG. 1) is activated, the charge 10 is initiated, thereby discarding the adapter 8, mainly through shearing off at the thread joint between the adapter and the shell. This separation causes a first decelerating force (directed to the right in FIG. 2), which reaches such a predetermined first level that the locking force of the magnet bolt 15 is counterbalanced, through which the magnet bolt moves to the left in FIG. 2, at which the firing pin 14 protrudes into the primer 16*a* in the clockwork 16. The arming delay of the clockwork 16 is chosen so that the clockwork with certainty has been armed before the magnet bolt 15 starts moving. The initiation of the primer produces a jet of flame which ignites the charge 17. Through the channels 18 in the charge 17 the black-powder charge 19 (see FIG. 1) is ignited, which in turn ignites the surrounded charge 7 which expels the subprojectile 2 from the shell.

Figure 3:
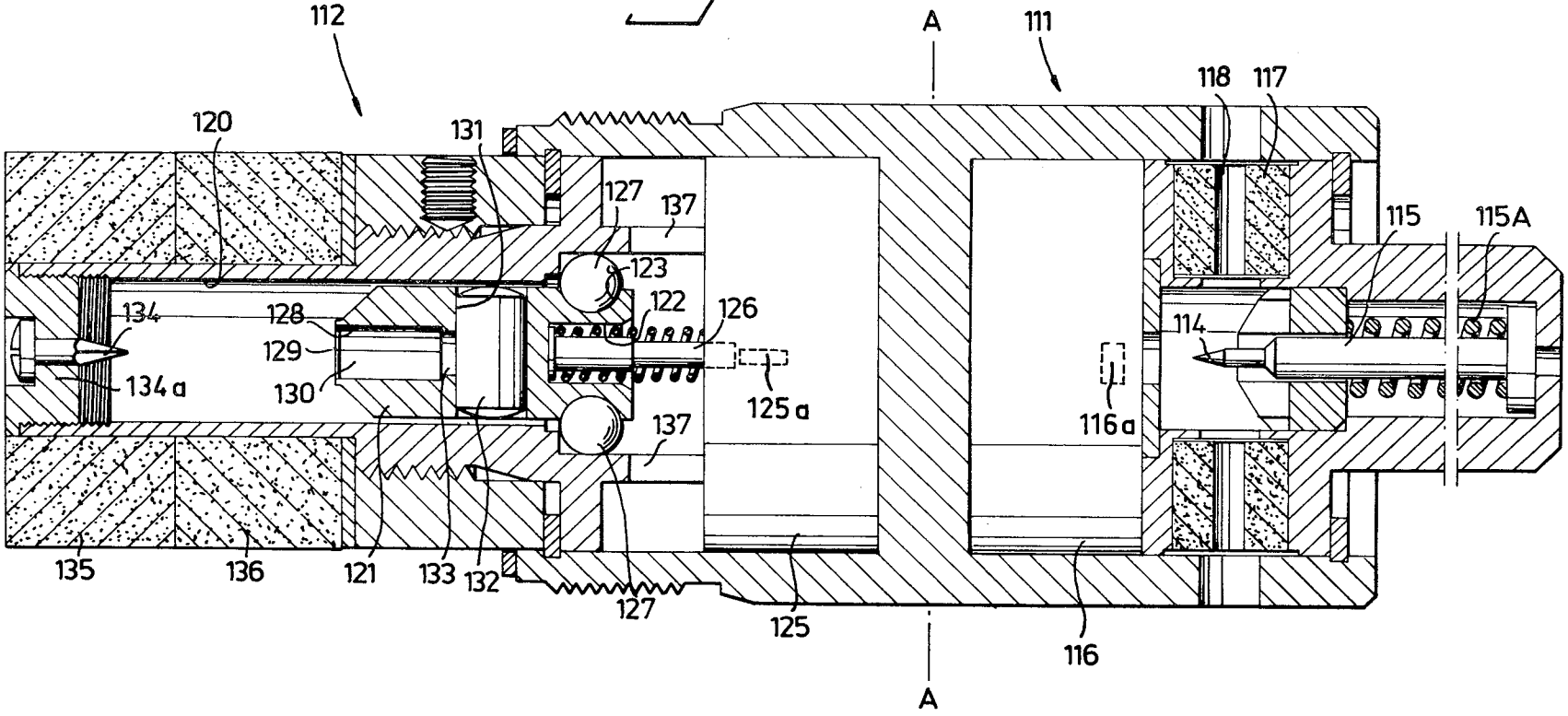
FIG. 3 shows an axial cross section of the fuze for the rear subprojectile shown in FIG. 1.

The rear part 111, see FIG. 3, of the fuze 103 in the rear subprojectile 102 also is provided with a bolt 115, provided with a firing pin 114. The bolt 115, however, is not of magnet type but is loaded by a powerful tension spring 115A. The spring 115A is dimensioned so that the above mentioned deceleration force caused by the expelling of the adapter 8 cannot move the firing pin 114 of the bolt 115 into contact with an initiation device, such as a primer 116*a* as shown schematically in the clockwork 16.

The expelling of the subprojectile 102 occurs in the following manner.

On expelling of the subprojectile 2 the shell is exposed to a deceleration force, which reaches a predetermined second level, which is sufficiently high to enable the deceleration force to move the bolt 115 against the action of the spring 115A, and sufficiently far to the left in FIG. 3 to permit the firing pin 114 to initiate the primer 116*a* which is arranged in the clockwork 116 (if this has been transferred to armed position in a conventional way), which ignites an annular charge 117 of pressed propellant. Through channels 118 in the charge 117 a black-powder charge 119 (see FIG. 1) in powder form, surrounding the fuze part 111 is ignited and in turn ignites the propelling charge 107, which expels the subprojectile 102 from the shell.

The discarding of the adapter 8 is arranged to give a first decelerating force, which exceeds the mentioned first level but preferably not the mentioned second level. If the first decelerating force exceeds both levels mentioned, which in principle may have the same or different values relative to one another, the second subprojectile 102 must be provided with a suitable safety device to prevent expelling of the subprojectile 102 at the same time as expelling of the first subprojectile 2. In this case the safety device should be arranged so that the subprojectile 102 is not armed until the adapter 8 has been discarded. Then the expelling of the subprojectile 102 takes place after sensing the decelerating force, which is caused by the expelling of the subprojectile 2. Since the subprojectile 102 is in safe position during the discarding of the adapter 8, the mentioned second level of the decelerating force that is caused by expelling the subprojectile 2 may thus be chosen arbitrarily in relation to the mentioned first level of the decelerating force that is caused be expelling the nose element 8.

In the embodiment of the invention described above the mentioned second level should preferably be chosen to be so high that the deceleration force on the discarding of the adapter 8 does not reach this level. Hereby the mentioned safety device for the subprojectile 102 can be eliminated.

The front sections 12 and 112 respectively of the fuzes 3 and 103 are essentially identically alike. Thus only the part 12 is described below.

The fuze part 12, see FIG. 2, is provided with an axial groove 20, in which ignition means such as a bolt 21 under certain conditions is movable. Ther rear part of the bolt 21 (to the right in the Figure) is provided with a central, axial recess 22 and with peripherial recesses 23. A compression spring 24 is in contact with one end against the bottom of the recess 22 and the other end against conventional arming means including an arming-clockwork 25, which for example is propelled by the rotation of the shell. A pin 26 is coaxially arranged inside the spring 24 and is in contact with a schematically shown stopping element 25*a* inside the clockwork 25. The clockwork 25 is arranged to arm before the expelling of the subprojectile 2 and to remove the mentioned stopping element 25*a* so that the pin 26 can move to the right, into the clockwork 25. By dimensioning the spring 24, desired initiation time may be achieved.

In the peripherial recesses 23, arming means such as balls 27 are arranged, which prevent movement of the bolt 21 to the left in FIG. 3.

The front part of the bolt 21 contains an axial channel 28, in which a primary bursting charge or detonator 30, provided with ignition means such as a primer 29 is arranged. The bolt 21 is also provided with a channel 31 which runs perpendicularly to the channel 28, in which a secondary bursting charge or detonator 32 is arranged. The channel 28 communicates with the channel 31 through a groove 33, the mouth of which is located in the channel 31 at substantially the same distance from its ends. On detonation of the detonator 30 a detonation wave is transmitted to the detonator 32 through the groove 33. Thereby the detonator 32 causes two detonation waves, which propagate from the middle of the channel 31 to the ends of the channel.

In the front part of the groove 20 an ignition body such as a firing pin 34 is stationarily arranged relative to a housing 34*a*.

Two annular, relatively inflammable bursting charges 35 and 36 surround the front part of the fuze section 12. The charges 35 and 36 are intended for initiation of the less inflammable main bursting charge 5, which is intended to, on detonation, blow up the fragmentation plate 6.

Detonation of the bursting charge of the subprojectile 2 occurs in the following manner.

On expelling of the subprojectile 2 from the shell, the subprojectile, at the moment of expelling, is subjected to a heavy acceleration stress which moves the bolt 21 rearwards (to the right in FIG. 2). Since the pin 26 bears against the bolt 21 it is conveyed rearwards by the bolt against the action of the spring 24. The clockwork 25 has previously been brought to armed position, whereby the mentioned stopping element in the clockwork has been removed, so that the pin 26 due to the mentioned acceleration stress protrudes further into the clockwork, thereby to cause the balls 27 to be forced into radial grooves 37 in the fuze. As soon as the acceleration stress on the subprojectile ceases, the bolt 21 will, partly due to deceleration caused by the air resistance, partly due to the effect of the spring 24, move foreward. Through suitable dimensioning of the spring 24, the initiation time thus can be varied. Since the balls 27 no longer limit the movement of the bolt 21, the bolt can move all the way to the firing pin 34, which initiates the primer 29, and then, in turn, the primary detonator 30, the secondary detonator 32, the bursting charges 35 and 36 and the main bursting charge 5 are initiated.

Detonation of the subprojectile 102 occurs in an analogous way.

In the shown embodiment the firing pin 34 is firmly connected to the subprojectile 2. It may, however, also be flexibly arranged in the housing 34*a*, see FIG. 2, in such a way that it, in safe position, does not protrude outside the housing 34*a*, and thus cannot be reached by the primer 29 in the bolt 21. In armed position, the firing pin 34, on the other hand, is brought forward to the position shown in FIG. 2, where the firing pin protrudes outside the housing 34*a* and thus can be reached by the primer 29 in the bolt 21.

According to another embodiment of the invention only the subprojectiles located at the very front of the projectile is/are arranged to be expelled by means of a fuze, which is initiated by means of a deceleration-sensing device. The subsequent subprojectiles may, instead be arranged to be expelled by means of fuzes, which are actuated in a conventional way, for example by means of pyrotechnic trains. If only the expelling of the subprojectile 2 shall be initiated by deceleration forces, a pyrotechnic train may connect, for example, the charges 19 and 119 with each other in such a way that the charge 119 is ignited after the charge 19 with a predetermined delay. Hereby, the deceleration-sensing device 14, 15 can be eliminated in the fuze 103 (see FIG. 3).

Instead of connecting the charges 19 and 119 with each other, the charges 17 and 117 may be arranged to be ignited at the same time as a consequence of the deceleration forces which occur due to the discarding of the nose element. Thereby the charge 117 contains a delay composition which delays the ignition of the charge 107.

The invention is not limited to the embodiments shown and described, but a great number of modifications of these embodiments are feasible within the scope of the appended claims.

We claim:

1. A projectile including a fuze for sensing a predetermined position in the trajectory of the projectile, a nose element, first expelling means for discarding the nose element in response to said sensing of said predetermined position in the trajectory of said projectile, at least one subprojectile, and second expelling means for expelling said at least one subprojectile from the projectile, said projectile further comprising deceleration-sensing means for sensing a predetermined first level of deceleration forces which affect the projectile as a consequence of said discarding of the nose element, and initiation means responsive to the sensing of said first level of the deceleration forces for actuating the second expelling means to expel the subprojectile.

2. A projectile in accordance with claim 1, further comprising a second subprojectile, third expelling means for expelling the second subprojectile from the projectile, second deceleration-sensing means for sensing a predetermined second level of the deceleration forces which affect the projectile due to said expelling of the first subprojectile, and second initiation means responsive to the sensing of said second level of the deceleration forces for actuating the third expelling means to expel the second subprojectile.

3. A projectile in accordance with claim 2, wherein said predetermined second level of the deceleration forces exceeds said predetermined first level of the deceleration forces, and said predetermined second level of the deceleration forces is so chosen that it is not reached by the deceleration forces which affect the projectile as a consequence of said separation of the nose element.

* * * * *

UNITED STATES PATENT AND TRADEMARK OFFICE

CERTIFICATE OF CORRECTION

PATENT NO. : 4,284,007

DATED : August 18, 1981

INVENTOR(S) : CLAES G. ARNELL ET AL

It is certified that error appears in the above—identified patent and that said Letters Patent is hereby corrected as shown below:

On the title page, in Section [30], insert

-- March 8, 1978 SWEDEN.....7802634 --.

Signed and Sealed this

*Twelfth* Day of *January 1982*

[SEAL]

*Attest:*

GERALD J. MOSSINGHOFF

*Attesting Officer* *Commissioner of Patents and Trademarks*